US007350725B2

(12) United States Patent
Dallimore et al.

(10) Patent No.: US 7,350,725 B2
(45) Date of Patent: Apr. 1, 2008

(54) CRUSHER AND A METHOD OF CRUSHING MATERIAL

(75) Inventors: Rowan Dallimore, Radstock (GB); George Fensome, Bristol (GB); Knut Kjaerran, Svedala (SE); Sven-Henrik Norman, Blentarp (SE)

(73) Assignee: Sandvik Intellectual Property AB, Sandviken (SE)

( * ) Notice: Subject to any disclaimer, the term of this patent is extended or adjusted under 35 U.S.C. 154(b) by 366 days.

(21) Appl. No.: 10/525,975

(22) PCT Filed: Aug. 27, 2003

(86) PCT No.: PCT/SE03/01320

§ 371 (c)(1),
(2), (4) Date: Aug. 5, 2005

(87) PCT Pub. No.: WO2004/020103

PCT Pub. Date: Mar. 11, 2004

(65) Prior Publication Data

US 2006/0011761 A1 Jan. 19, 2006

(30) Foreign Application Priority Data

Aug. 28, 2002 (SE) ..... 0202535

(51) Int. Cl.
*B02C 19/06* (2006.01)

(52) U.S. Cl. ..... 241/5; 241/275

(58) Field of Classification Search ..... 241/5, 241/26, 275
See application file for complete search history.

(56) References Cited

U.S. PATENT DOCUMENTS

| | | | | |
|---|---|---|---|---|
| 2,012,694 | A | 8/1935 | Runyan | |
| 3,154,259 | A | 10/1964 | Behnke et al. | |
| 3,429,511 | A | 2/1969 | Budzich | |
| 4,515,316 | A * | 5/1985 | Kawaguchi | 241/5 |
| 4,662,571 | A | 5/1987 | MacDonald et al. | |
| 5,145,118 | A * | 9/1992 | Canada | 241/81 |
| 6,416,000 | B1 | 7/2002 | Lusty et al. | |

OTHER PUBLICATIONS

International Search Report of Application No. SE 0202535-1.

* cited by examiner

*Primary Examiner*—Faye Francis
(74) *Attorney, Agent, or Firm*—Drinker Biddle & Reath LLP

(57) ABSTRACT

A method of crushing material includes the steps of feeding a first flow of material to be crushed to a rotor rotating around a vertical axis, the rotor accelerating the first flow of material towards an impact wall section, and feeding a second flow of material to be crushed into the path of the accelerated first flow of material. The second flow of material is fed in a direction having a substantially tangential component in relation to the rotor, such that the second flow of material will have a substantially tangential component of movement in relation to the rotor when reaching the path of the first flow of material. A crusher is adapted to feed the second flow of material such that it will have a substantially tangential component of movement in relation to the rotor when reaching the path of the first flow of material.

10 Claims, 7 Drawing Sheets

CRUSHER AND A METHOD OF CRUSHING MATERIAL

TECHNICAL FIELD OF THE INVENTION

The present invention relates to a vertical shaft impact crusher for crushing material, said crusher comprising a rotor for accelerating a first flow of material to be crushed, a first feed means for vertically feeding the first flow of material to the rotor, a housing comprising a wall with a circumferential impact wall section against which the accelerated first flow of material may be crushed, a second feed means for feeding a second flow of material to be crushed into the path of the accelerated first flow of material.

The present invention further relates to a method of crushing material, said method comprising the steps of feeding a first flow of material to be crushed to a rotor rotating around a vertical axis, in said rotor accelerating said first flow of material towards an impact wall section of a housing surrounding the rotor, feeding a second flow of material to be crushed into the path of the accelerated first flow of material.

BACKGROUND ART

Vertical shaft impact crushers (VSI-crushers) are used in many applications for crushing hard material like rocks, ore etc. U.S. Pat. No. 3,154,259 describes a VSI-crusher comprising a housing and a horizontal rotor located inside the housing. Material that is to be crushed is fed into the rotor via an opening in the top thereof. With the aid of centrifugal force the rotating rotor ejects the material against the wall of the housing. On impact with the wall the material is crushed to a desired size. The housing wall could be provided with anvils or have a bed of retained material against which the accelerated material is crushed.

To increase the amount of material crushed by the crusher two separate material flows could be fed to the crusher. A first material flow is fed to the rotor. The first material flow is accelerated by the rotor and is ejected towards the housing wall. A second material flow is fed outside the rotor, i.e. between the rotor and the housing. This second material flow is hit by the first material flow ejected by the rotor. Thus the first and second material flows are crushed against each other just outside the rotor.

U.S. Pat. No. 2,012,694 to Runyan describes a crusher where a first flow of material is fed to the centre of a rotating rotor. A second flow of material is fed at the wall of a crusher housing via a feeder comprising two spaced cones. At the housing wall the second flow of material is hit by the first flow of material ejected by the rotor.

U.S. Pat. No. 3,429,511 to Budzich describes a crusher where a first flow of material is fed to the centre of a rotating rotor. A second flow of material is fed via a feeding gap extending around the rotor. The second flow of material forms a continuous curtain of flowing material covering the pathway of the first flow of material just outside the rotor. The first flow of material ejected by the rotor thus hits and crushes the second flow of material.

U.S. Pat. No. 4,662,571 to MacDonald describes a crusher were a first flow of material is fed to the centre of a rotating rotor. A second flow of material is fed into the path of the first material flow accelerated by said rotor before said first material impacts against the crusher wall.

The above crushers do not to utilize the energy of the first flow of material in a very efficient way.

SUMMARY OF THE INVENTION

It is an object of the present invention to provide a crusher which utilizes the energy of a first flow of material accelerated by a rotor in a more efficient way.

This object is achieved by a crusher according to the preamble and characterized in that the second feed means comprises means for forming at least one hillside on which the second flow of material may slide, the hillside having a slope being substantially tangential in relation to the rotor for directing the second flow of material in a direction having a substantially tangential component in relation to the rotor, such that the second flow of material will have a substantially tangential component of movement in relation to the rotor when reaching the path of the first flow of material.

The present invention thus provides a second flow of material having a substantially tangential component of movement. This improves the crushing action and makes it possible to direct the second flow of material towards positions suitable for impact and away from the periphery of the rotor and the internal structures, such as internal beams of the crusher. The versatility of the crusher is improved resulting in the ability to increase the throughput and to alter the size distribution curve of the crushed product.

Preferably the wall of the housing comprises a circumferential distributing wall section forming part of the second feed means and being located above said impact wall section, the second feed means comprising means for feeding, in a first step, the second flow of material in a direction towards the distributing wall section, which is adapted to receive the second flow of material and to direct it against the impact wall section.

The distributing wall section makes it possible to give the second flow of material a desired velocity and the desired direction just before it is to enter the impact wall section.

Preferably the feed hopper means comprises an inner hopper and an outer hopper surrounding the inner hopper, said hoppers having a common vertical axis substantially coinciding with the vertical axis of the rotor, the inner hopper being provided with at least one outlet for allowing the second flow of material fed to the inner hopper to enter a space formed between the inner and the outer hopper, an "L"-shaped direction arm being fixed in the space between said hoppers just outside said outlet to facilitate the building of a hillside of accumulated material, the hillside having a slope being tangential in relation to the rotor for directing the second flow of material towards the distributing wall section.

The inner and outer hopper provides an efficient way of distributing the desired amount of material for forming the second flow of material. The hillside formed on the direction arm provides an efficient base for giving the second flow of material the desired direction without causing wear to internal components including the direction arm itself.

Preferably a horizontal leg of the "L"-shaped direction arm is pointing in the rotational direction of the rotor, such that any dust entrained by the rotor in a direction having an upwardly directed component and a component being tangential in relation to the rotor will be hindered by a vertical leg of the direction arm.

The vertical leg of the direction arm will efficiently decrease the dust emission from the inner hopper. Thus expensive filtering means for filtering emitted air may be omitted. It also becomes much easier to inspect the crusher during operation and to observe the amount of material forming the second flow of material.

Preferably the inner and outer hoppers have a polygonal shape as seen from above. The polygonal shape is preferable since it makes the manufacturing of outlets formed in the inner hopper and in particular hatches for covering said outlets much easier since they all can be made flat. The polygonal shape also assists in reducing dust emissions from the crusher since the internal corners of the polygonal hoppers will get filled with dust thereby creating dead pockets of retained dust, which help absorbing the air flow created by the rotor. The polygonal shape also helps deflecting the air streams swirling around inside the crusher. The dead pockets of retained dust will also protect the inner and outer hopper from wear.

Preferably the second feed means further comprises the upper surface of a ring fixed to the inner wall of said housing to separate the distributing wall section from the impact wall section located below it. The ring provides a base for the distributing wall section and prevents any material from the impact wall section from bouncing up to the distributing wall section. Also material from the distributing wall section will be prevented from entering the impact wall section in places where it is not desired. The separation of the distributing wall section from the impact wall section thus makes the crushing more efficient and decreases wear on internal parts of the crusher.

Preferably the second feed means further comprises at least one vertical collection plate extending radially with respect to the rotor, the collection plate being fixed to the upper face of the ring at such a location that a part of the second flow of material fed towards the distributing wall section in said first step will accumulate against the collection plate to form a hillside of material, the hillside having a slope being substantially tangential in relation to the rotor for giving, in a second step, the remaining part of the second flow of material a substantially tangential component of movement in relation to the rotor when reaching the path of the first flow of material. The hillside formed will protect the internal parts, including the collection plate and the upper surface of the ring from wear. The hillside will also provide the desired direction for the second flow of material before the second flow of material enters the impact wall section.

A further object of the present invention is to provide a method of crushing material which improve the utilization of the energy supplied during the crushing.

This object is achieved with a method according to the preamble and characterized in feeding the second flow of material in a direction having a substantially tangential component in relation to the rotor, such that the second flow of material will have a substantially tangential component of movement in relation to the rotor when reaching the path of the first flow of material. The inventive method makes it possible to direct the second flow of material towards positions attractive for impact and away from internal structures such as internal beams of the crusher. Thus crushing action and utilization of crushing energy is improved and wear inside the crusher is reduced.

Preferably the second flow of material is fed into the path of the first flow of material adjacent to the impact wall section. An advantage with this is that the second flow of material will, after being hit by the first flow of material, impact against the impact wall section. Thus the second flow of material will be crushed against the impact wall section and it will also be subjected to further hits of the first flow of material. The retention time of the second flow of material at the impact wall section will thus be increased. This is a large advantage over prior art crushers where a second flow of material randomly falls freely between the rotor and the crusher wall. This random falling of the prior art crushers results in that a major part of a second flow of material will never be hit by the first flow of material. The randomly falling second flow of material of the prior art crushers will also deflect the first flow of material thus reducing or eliminating the crushing against the crusher wall. Another advantage of the present invention is that the risk that the second flow of material accidentally impacts the rotor is decreased. Also the risk of the first flow of material accidentally rebounding against the rotor or other internal structures after hitting the second flow of material is decreased. Thus the wear on the crusher and in particular on the rotor is decreased.

Preferably the second flow of material is fed from a position adjacent to the axis of the rotor towards a wall of the housing in a direction having a substantial tangential component in relation to the rotor. The central feeding of the material makes it possible to feed in one position and then divide the flow of material into a first flow of material and a second flow of material. The feeding towards the wall increases the chance of placing the second flow of material in a position suitable for best crushing performance. In particular the chance of the second flow of material reaching the path of the first flow of material adjacent to the impact wall is improved.

BRIEF DESCRIPTION OF THE DRAWINGS

The invention will hereafter be described in more detail and with reference to the appended drawings.

DETAILED DESCRIPTION OF PREFERRED EMBODIMENTS OF THE INVENTION

Figure 1:
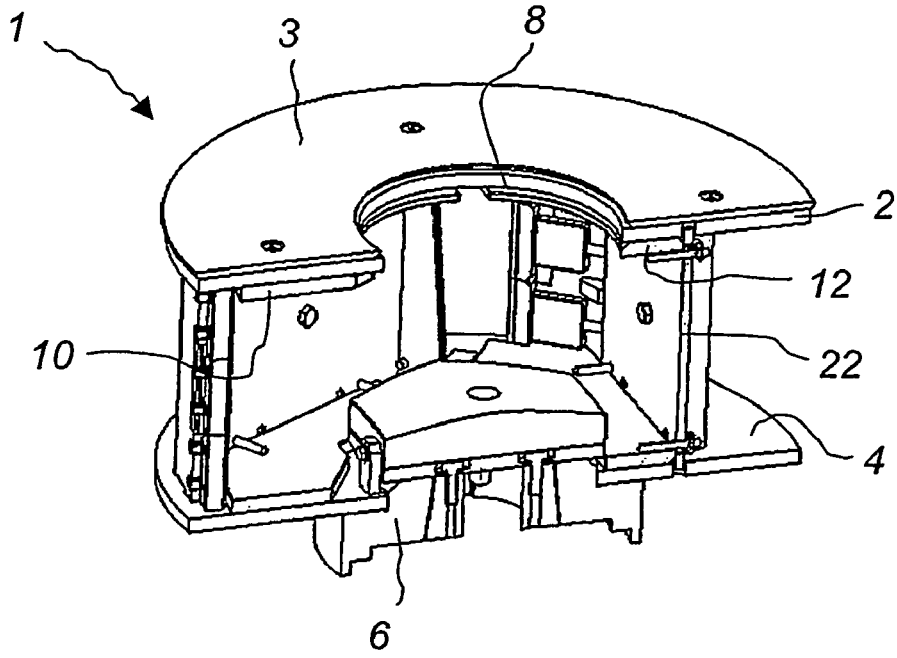
FIG. 1 is three-dimensional section view and shows a rotor for a VSI-crusher

FIG. 1 shows a rotor 1 for use in a VSI-crusher. The rotor 1 has a roof in the form of an upper disc 2 having a top wear plate 3 and a floor in the form of a-lower disc 4. The lower disc 4 has a hub 6, which is welded to the disc 4. The hub 6 is to be connected to a shaft (not shown) for rotating the rotor 1 inside the housing of a VSI-crusher.

The upper disc 2 has a central opening 8 through which material to be crushed can be fed into the rotor 1. The upper disc 2 is protected from wear by upper wear plates 10 and 12. The upper disc 2 is protected from rocks impacting the rotor 1 from above by the top wear plate 3. As is better shown in FIG. 2 the lower disc 4 is protected from wear by three lower wear plates 14, 16 and 18.

The upper and lower discs 2, 4 are separated by and held together by a vertical rotor wall which is separated into three wall segments 20, 22 and 24. The gaps between the wall segments 20, 22, 24 define outflow openings 26, 28, 30 through which material may be ejected against a housing wall.

At each outflow opening 26, 28, 30 the respective wall segment 20, 22, 24 is protected from wear by three wear tips 32, 34, 36 located at the trailing edge of the respective wall segment 20, 22, 24.

A distributor plate 38 is fastened to the centre of the lower disc 4. The distributor plate 38 distributes the material that is fed via the opening 8 in the upper disc 2 and protects the lower disc 4 from wear and impact damages caused by the material fed via the opening 8.

Figure 3:
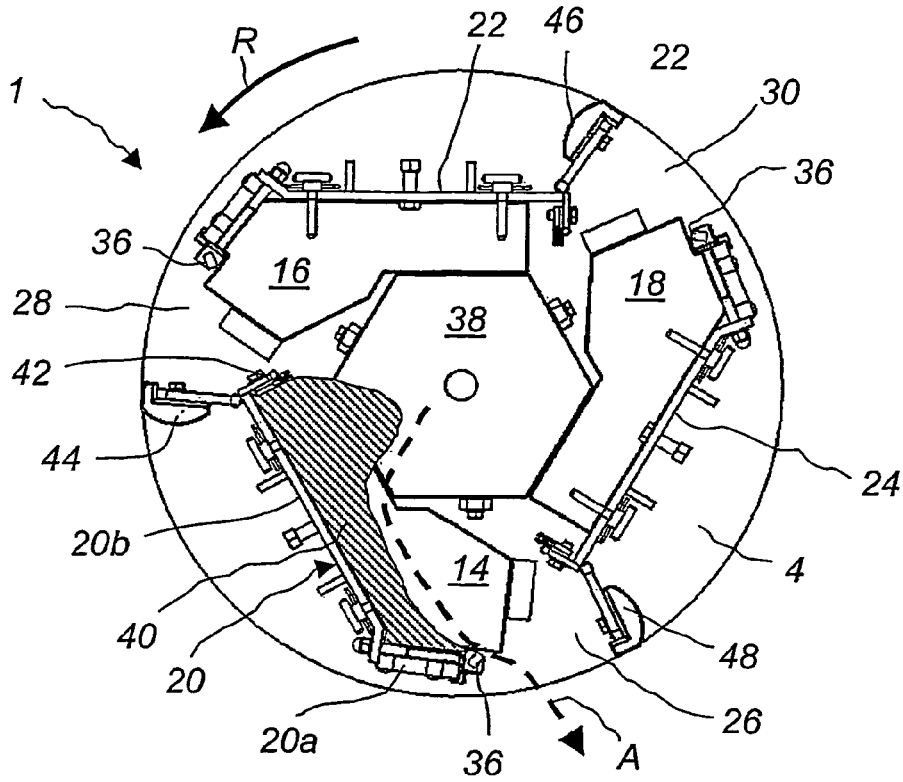
FIG. 3 shows the view of FIG. 2 as seen from above in a two dimensional perspective.

During operation of the rotor 1 a bed 40 of material is built up inside the rotor 1 against each of the three wall segments 20, 22, 24. In FIG. 3 only the bed 40 located adjacent to the wall segment 20 is shown. The bed 40, which consists of material that has been fed to the rotor 1 and then has been trapped inside it, extends from a rear support plate 42 to the wear tips 32, 34, 36. The bed 40 protects the wall segment 20 and the wear tips 32, 34, 36 from wear and provides a proper direction to the ejected material. The dashed arrow A describes a typical passage of a piece of rock fed to the rotor 1 via the central opening 8 and ejected via the outflow opening 26. The arrow R indicates the rotational direction of the rotor 1 during operation of the VSI-crusher.

Each wall segment 20, 22, 24 is provided with a cavity wear plate 44, 46, 48, each preferably having three cavity wear plate portions. The cavity wear plates 44, 46, 48 protect the rotor 1 and in particular the wear tips 32, 34, 36 from material rebounding from the housing wall and from ejected material and airborne fine dust spinning around the rotor 1.

Figure 4:
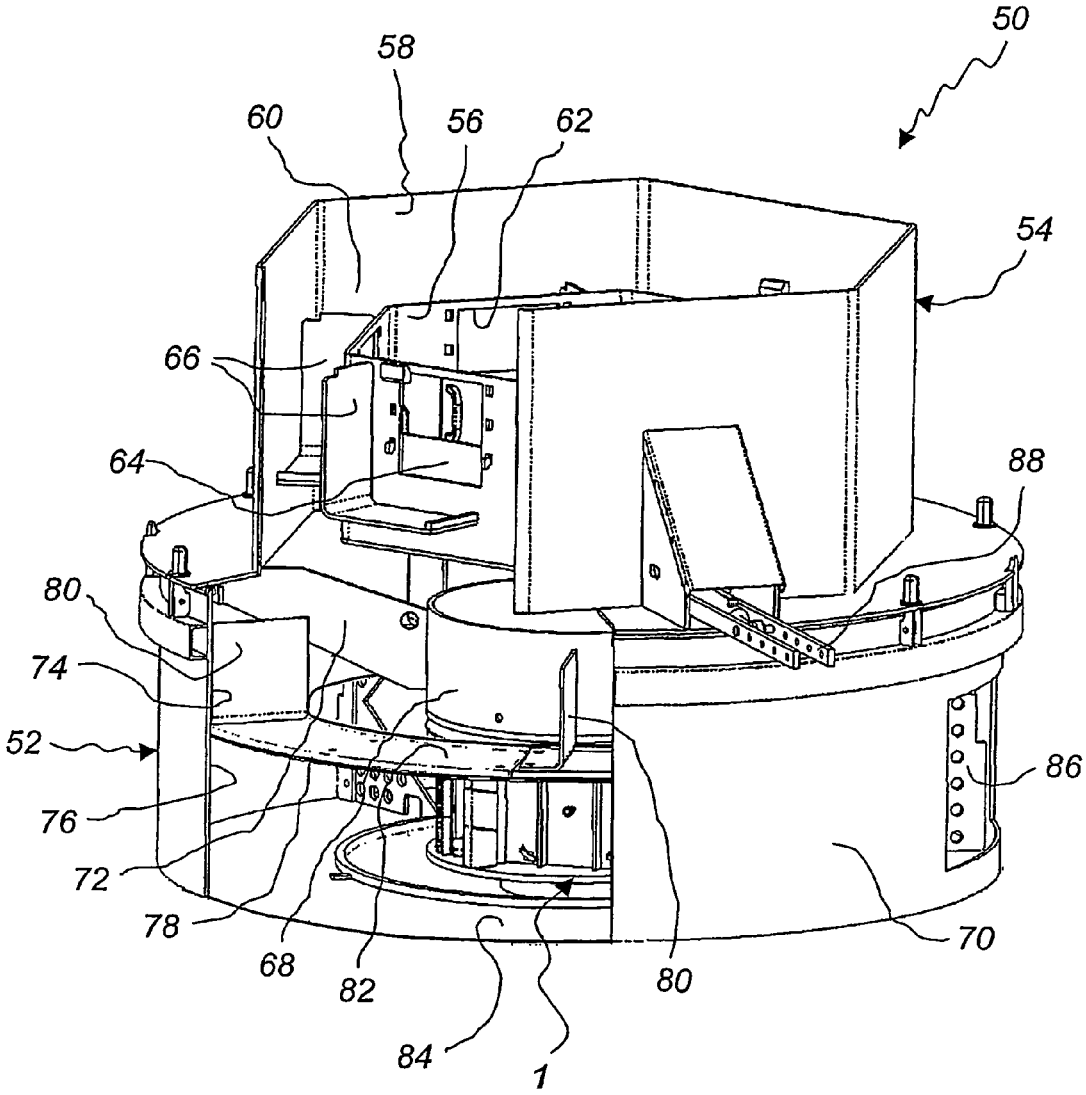
FIG. 4 is a three dimensional view, partly in section, and shows a vertical shaft impact crusher.

In FIG. 4 a vertical shaft impact crusher 50 is shown. The rotor 1 is located inside a housing 52 of the crusher 50. At the top of the crusher 50 a feed hopper means 54 is located. The feed hopper means 54 has a hexagonal inner hopper 56 and a hexagonal outer hopper 58. A roof, not shown in FIG. 4, seals a space 60 formed between the inner hopper 56 and the outer hopper 58 from above. The inner hopper 56 is provided with six outlets 62, each outlet 62 being located at a side of the hexagonal inner hopper 56. Each outlet 62 is provided with a movable hatch 64. The movable hatch 64 may be placed in three different positions on the inner hopper 56 to obtain a desired open area of the respective outlet 62. An "L"-shaped direction arm 66 is fixed between the inner hopper 56 and the outer hopper 58 adjacent to each outlet 62. Below the inner hopper 56 a central feeding cylinder 68 is placed. The feeding cylinder 68 is fixed to the inside of the wall 70 of the housing 52 with the aid of three beams of which only the beam 72 is shown in FIG. 4.

A circumferential distributing wall section 74 is located at the same level as the feeding cylinder 68. Below the distributing wall section 74 and on the same level as the rotor 1 a circumferential impact wall section 76 is located. A cavity ring 78 separates the distributing wall section 74 from the impact wall section 76. A number of vertical collection plates 80 which extend radially with respect to the rotor 1 are fixed to the upper surface 82 of the ring 78.

A bed retention ring 84 is located at the bottom of the crusher 50. A number of bed support plates 86 are located between the bed retention ring 84 and the cavity ring 78. A throttle means 88, partly shown in FIG. 4, is located between the inner hopper 56 and the feeding cylinder 68.

Figure 5:
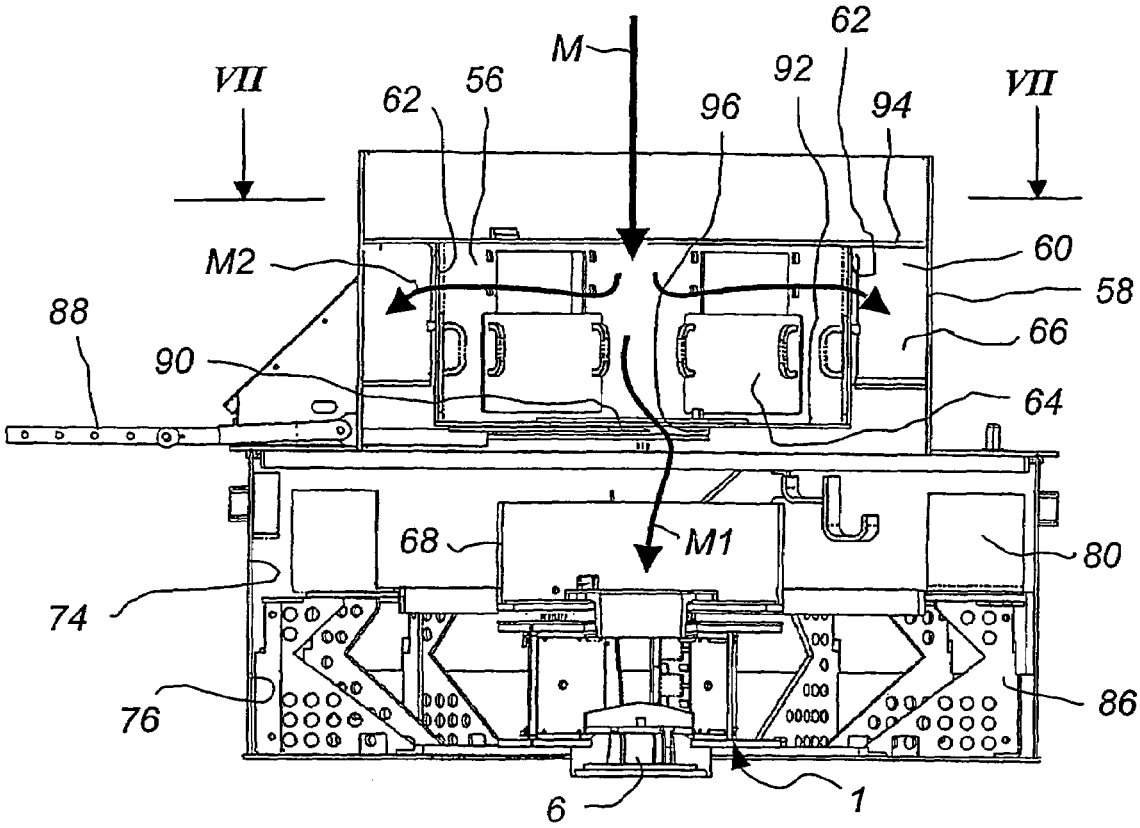
FIG. 5 is a section view and shows the crusher of FIG. 4.

FIG. 5 shows that the throttle means 88 controls a sliding throttle 90 located at the bottom 92 of the inner hopper 56. Material to be crushed is fed to the inner hopper 56 in the direction of the arrow M. The roof 94 prevents material from falling directly into the space 60 between the inner hopper 56 and the outer hopper 58. The roof 94 also prevents dust from flowing out of the top of the crusher 50. The opening position of the sliding throttle 90 determines the amount of material forming a first flow of material M1 that will reach the rotor 1 via an inlet 96 at the bottom 92 of the inner hopper 56 and the feeding cylinder 68 in relation to the amount of material forming a second flow of material M2 that will reach the space 60 via the outlets 62.

Figure 6:
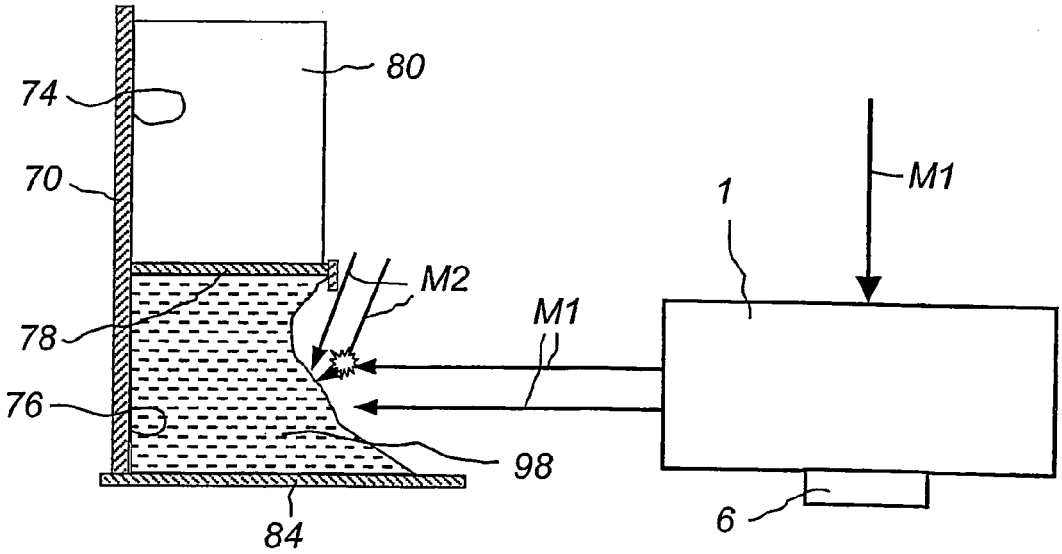
FIG. 6 is a schematic section view and shows the build up of a bed of retained material against an impact wall section.

FIG. 6 shows how the rotor 1, being rotated with the aid of a not shown shaft connected to the hub 6, will accelerate the first flow of material M1 against the impact wall section 76. Quite soon after the crusher operation has been started some crushed material will accumulate against the impact wall section 76 to form a wall bed 98 of retained material as shown in FIG. 6. The bed support plates 86, the bed retention ring 84 and the cavity ring 78 will support the bed and provide a desired shape. The first flow of material M1 will be accelerated by the rotor 1 and impact against the wall bed 98 of retained material. Thus a so called autogenous crushing is obtained wherein the first flow of material M1 is crushed against a wall bed 98 formed from part of the material previously crushed.

Figure 7:
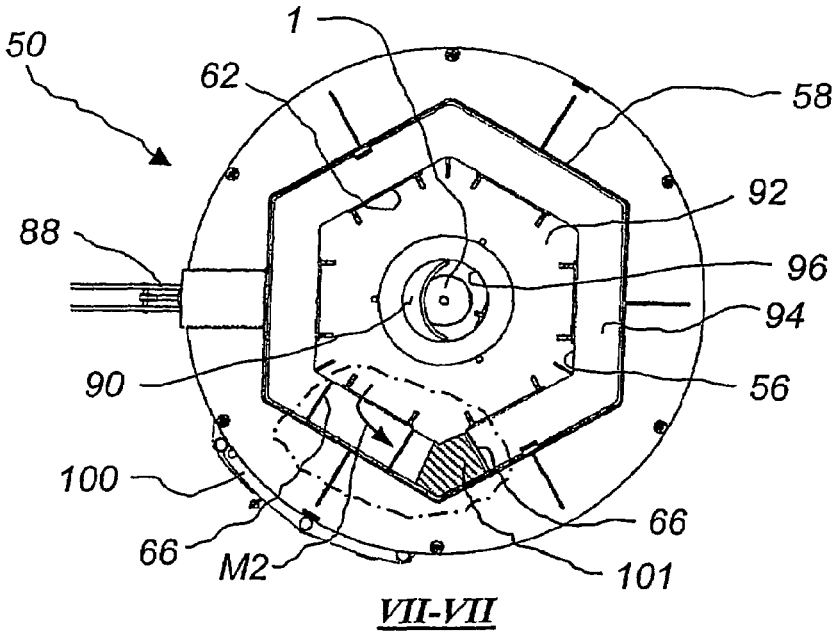
FIG. 7 is a section view taken along the line VII-VII of FIG. 5.

FIG. 7 shows, as seen from above, the sliding throttle 90 and the inlet 96 at the bottom 92 of the inner hopper 56. An inspection hatch 100 makes it possible to inspect the rotor 1 and perform maintenance inside the crusher 50. In FIG. 7 the roof 94 has been partially removed to visualize an advantageous effect of the polygonal hoppers 56, 58. Between two adjacent direction arms 66 a dead pocket 101 of accumulated material has been built up during crusher operation. The dead pocket 101, being formed between the polygonal hoppers 56 and 58, protects the direction arm 66, the roof 94 and the hoppers 56, 58 against wear caused by the second flow of material M2.

Figure 8:
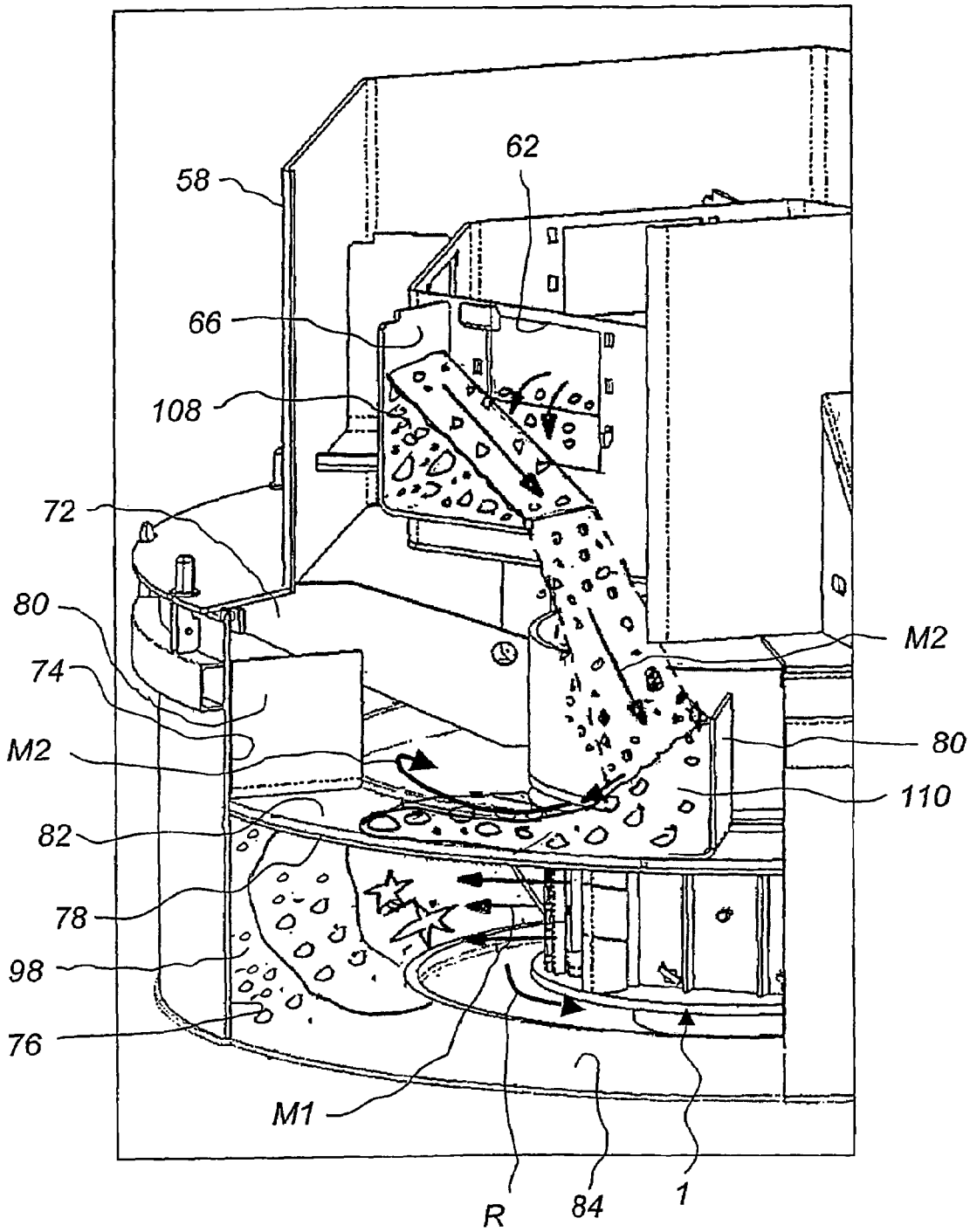
FIG. 8 is a three dimensional view, partly in section, and shows the pathway of the second flow of material of the vertical shaft impact crusher.
Figure 9:
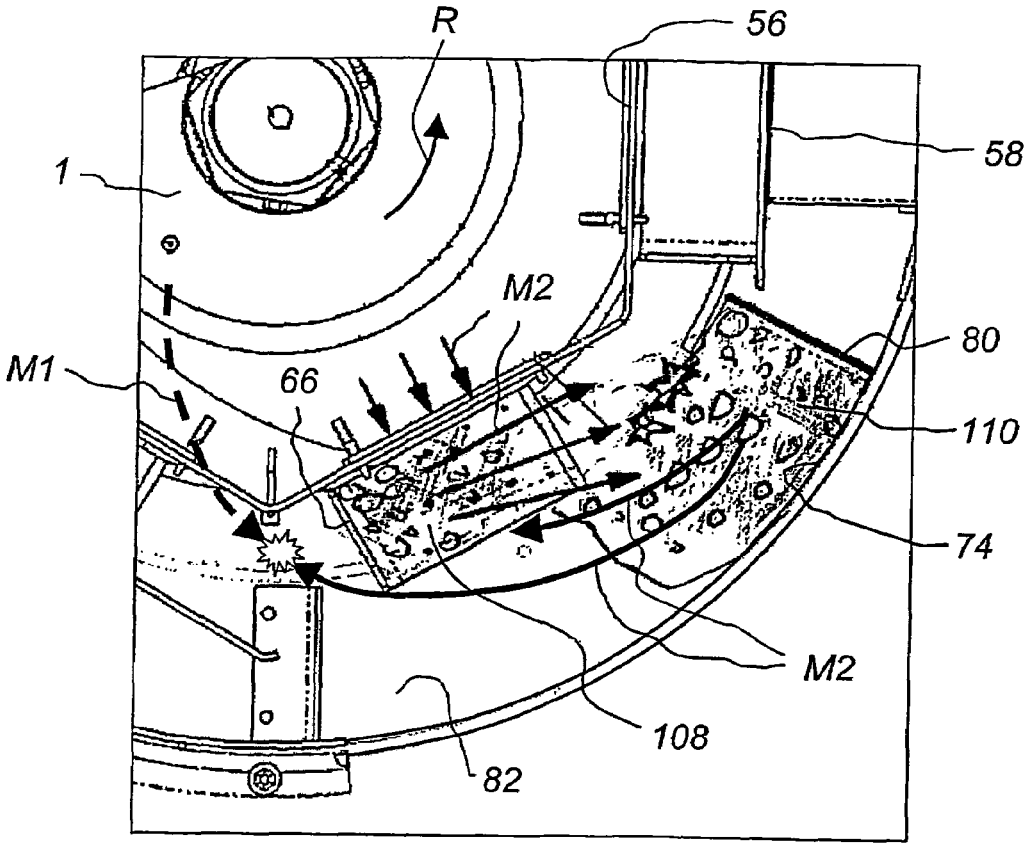
FIG. 9 is a top view, partly in section, and shows the pathway of the second flow of material of the vertical shaft impact crusher.
Figure 10:
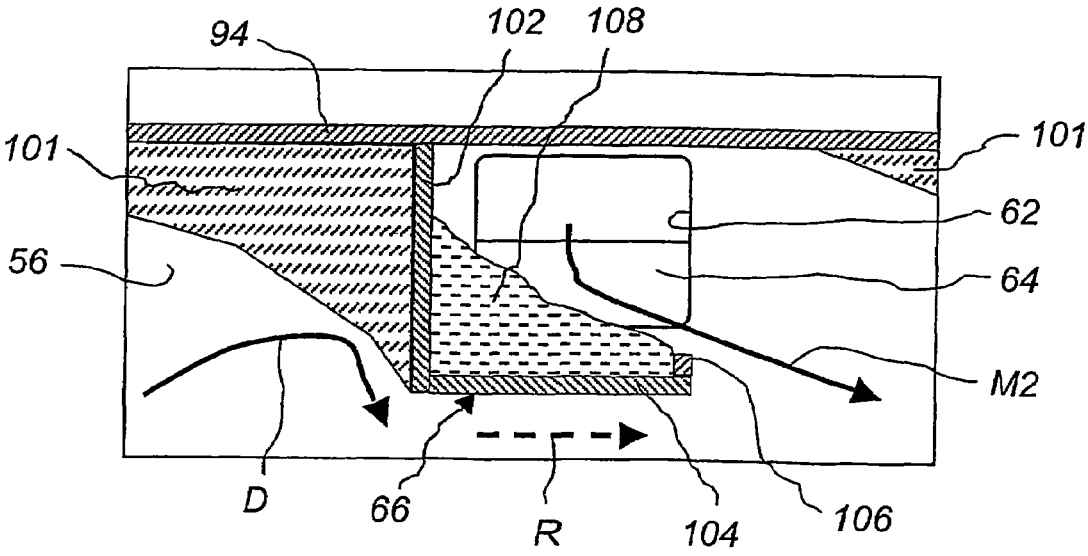
FIG. 10 is a side view showing a direction arm in detail.

The operation of the crusher 50 will now be described in more detail with reference to FIG. 8 to 10. As described with reference to FIG. 5 the feed of material M is divided in a first flow of material M1 and a second flow of material M2. The second flow of material M2 passes out of the outlets 62 and lands on the direction arms 66. Each direction arm 66 has, as is best shown in FIG. 10, a vertical leg 102 and a horizontal leg 104. At an end of the horizontal leg 104 a projection 106 has been welded. The second flow of material M2 will initially build a hillside 108 of material on the direction arm 66. Once the hillside 108 is in place, after few minutes of crusher operation, the second flow of material M2 will slide on the hillside 108 thus obtaining a movement having a substantially tangential component in relation to the rotor 1, as can be seen from FIG. 8 and FIG. 9. The second flow of material M2 will thus in this first step be directed towards the distributing wall section 74. At the location of the distributing wall section 74 where the second material flow would impinge the wall section 74 the collection plate 80 is located. During the first minutes of crusher operation the second flow of material M2 will build a second hillside 110 of material against the collection plate 80 and the upper surface 82 of the cavity ring 78 as is best shown in FIG. 8. After the second hillside 110 has been established the rest of the second flow of material M2 will, in a second step, slide on the second hillside 110. The second material flow M2 will thus, in this second step, obtain a movement having a substantially tangential component in relation to the rotor 1. The second material flow M2 will then pass on down into a position adjacent to the impact wall section 76. Adjacent to the impact wall section 76 the second flow of material M2 having a movement with a substantially tangential component will be hit by the first flow of material M1 ejected by the rotor. When the second flow of material M2 is hit by the first flow of material M1 it will be forced against the wall bed 98. Since the second flow of material M2 is fed adjacent to the impact wall section 76 the second flow of material M2 will land on the wall bed 98 either directly or after being hit by the first flow of material M1 and be exposed to the impact of the first flow of material M1 for a long period of time thus achieving an efficient crushing. It will be appreciated that, as clearly demonstrated in FIG. 6, any part of the second flow of material M2 that by accident is not immediately hit by the first flow of material M1 will also land on the wall bed 98 thus getting more chances of being hit by the first flow of material M1. This effect is enhanced by the fact that the second flow of material M2 is given a tangential component of movement by the second hillside 110 and is thus directed against the wall bed 98. Thus any part of the second flow of material M2 that is not hit by the first flow of material M1 (as illustrated in FIG. 9) will instead directly impact the wall bed 98 and be retained there for some time. The increased retention time of the second material flow M2 on the wall bed 98 is particularly important since the first flow of material M1 will appear to be pulsed when leaving the rotor 1. Since the rotor 1 is rotated and the first flow of material M1 is ejected through the three outflow openings 26, 28, 30 of the rotor 1, a given portion of the wall bed 98 will become hit by the first flow of material M1 three times per each revolution of the rotor 1, i.e. if the rotor rpm is 1500, a given portion of the wall bed 98 will become hit 3×1500=4500 times per minute. The increased retention time of the second flow of material M2 on the wall bed 98 ensures that the second flow of material M2 will become hit by the first flow of material M1 before leaving the crusher. In fact the second flow of material M2 will be hit many times by the first flow of material M1 thus ensuring an efficient crushing. FIG. 8 further shows that the internal beam 72 has such a location in relation to the collection plate 80 that the beam 72 is not hit by the second flow of material M2.

As is indicated with a dashed arrow in FIG. 9 the movement of the first flow of material M1 will have a substantially tangential component. Since the second flow of material M2 has a movement with a substantially tangential component having the opposite direction, the first flow of material M1 will impact the second flow of material M2 in a head-on collision thus further improving the crushing action. The fact that the first and second flows of material M1, M2 travel in opposite directions before impacting each other provides an optimum initial impact energy.

From FIG. 10 another important aspect of the direction arm 66 is shown. The rotation of the rotor 1 will cause entrainment of dust particles. The particles will swirl along the rotational direction, shown with a dashed arrow R in FIG. 10, of the rotor 1 and move up an down in the crusher 50. The vertical leg 102 of the direction arm 66 and the horizontal leg 104 pointing in the direction of the rotational direction R will however deflect the dust particles and force them down into the crusher 50, as indicated with an arrow D in FIG. 10. Thus the dust emissions from the crusher 50 will be substantially reduced thanks to the direction arm 66. The dead pocket 101 built up against the vertical leg 102 improves the deflection of the dust particles and also protects the vertical leg 102, the roof 94, the inner hopper 56 and the outer hopper 58 (not shown in FIG. 10) from wear. The polygonal shapes of the inner hopper 56 and the outer hopper 58 will tend to diffuse the air rotating inside the crusher. The polygonal shape thus assists in decreasing the dust emission from the crusher.

It will be appreciated from FIG. 9 that a minor part of the second flow of material M2 sliding on the hillside 108 may not reach the distributing wall section 74 and the second hill 110. This minor part of the second flow of material M2 will, however, also have a movement with a substantially tangential component and will be directed directly towards the impact wall section 76 where it is hit by the first flow of material M1.

Figure 2:
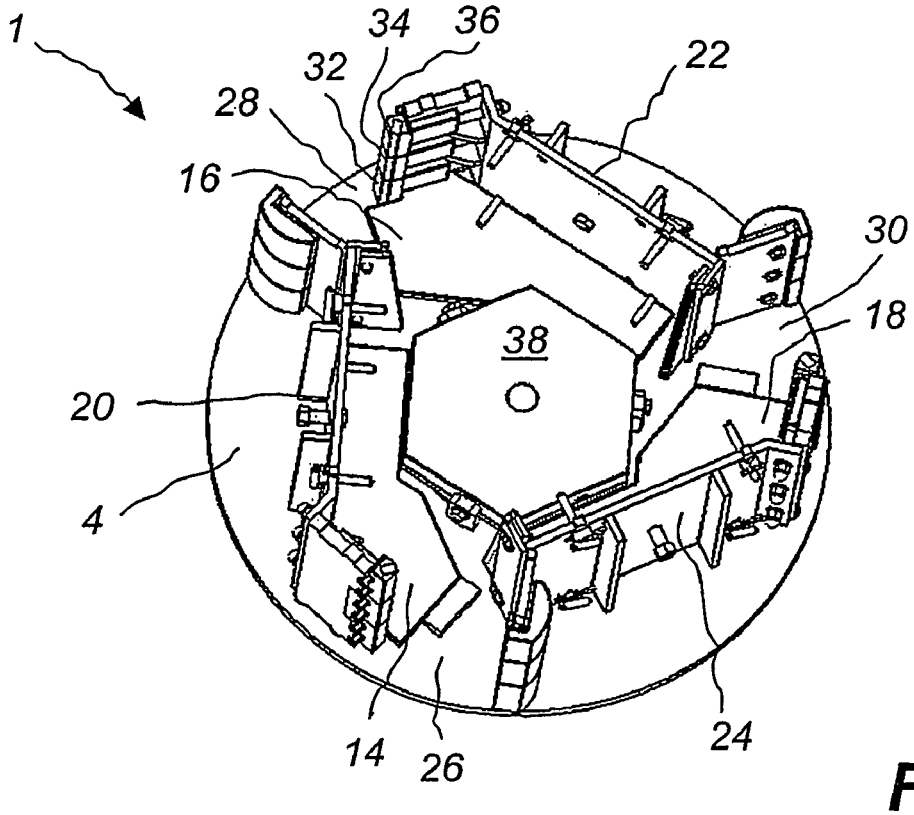
FIG. 2 is a three-dimensional view and shows the rotor of FIG. 1 with the upper disc removed.
Figure 11:
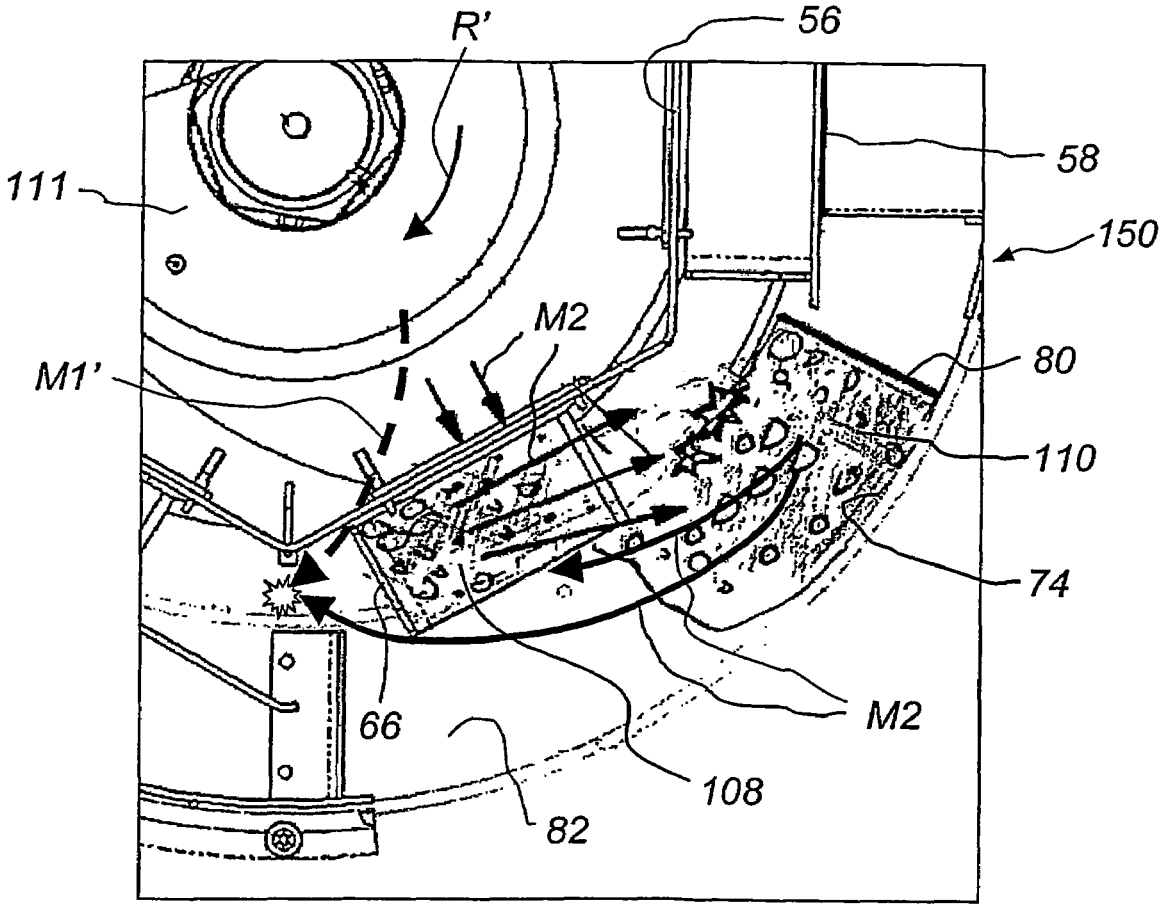
FIG. 11 is a top view, partly in section, and shows the pathways of the first and the second flows of material according to an alternative embodiment of the invention.

FIG. 11 illustrates an alternative embodiment of the invention. A vertical shaft impact crusher 150, similar to the crusher 50 shown in FIG. 4-10, is equipped with a rotor 111. The rotor 111 is similar to the rotor 1 that is illustrated in FIG. 1-3 but is adapted to be rotated in the opposite direction R', i.e. clockwise. The rotor 111 will thus produce a first flow of material M1' that has another direction than the first flow of material M1 shown in FIG. 9. As is indicated with a dashed arrow in FIG. 11 the movement of the first flow of material M1' will have a substantially tangential component. Since the second flow of material M2 has a movement with a substantially tangential component having the same direction, the first flow of material M1' will impact the second flow of material M2 in a "from behind" collision. The fact that the first and second flows of material M1', M2 travel in the same direction before impacting each other provides a reduced impact action compared to the head-on collision illustrated in FIG. 8-9 but instead an improved grinding and attrition action. The grinding and attrition action provides an improved shape, i.e. an improved roundness, to the material that is fed to the crusher. Thus the embodiment illustrated in FIG. 11 is particularly suitable for cases where the material to be crushed requires a moderate to low reduction in size but an increased roundness. It will be appreciated that an alternative way of achieving the "from behind" collision is to keep the rotor 1 having the direction of rotation R in the crusher and instead alter the direction of the direction arm 66 and change the position of the collection plate 80 to obtain a second flow of material having the opposite direction compared to the second flow of material M2 shown in FIGS. 9 and 11.

It will be appreciated that numerous modifications of the embodiments described above are possible within the scope of the appended claims.

In an alternative embodiment of the invention only the hillside 108 is used. In such an embodiment the hillside 108 formed on the direction arm 66 directs the second flow of material M2 directly towards the impact wall section 76 without going via the distributing wall section, which may be omitted in this alternative embodiment. The second flow of material M2 thus having a movement with a substantially tangential component will reach the path of the first flow of material M1 adjacent to the impact wall section 76 and be subjected to multiple hits by the first flow of material M1 at the wall bed 98 just like in the embodiment described above.

In still another embodiment of the invention only the hillside 110 is used. In such an embodiment the second flow of material M2 is dropped vertically on the upper surface 82 of the cavity ring 78. A collection plate 80 located on the surface 82 will provide a basis for the accumulation of a hillside 110. The second flow of material M2 falling vertically on the hillside 110 will slide on the hillside 110 thus obtaining a movement having a substantially tangential component in relation to the rotor 1. The second flow of material M2 will then enter the impact wall section 76 and be crushed in accordance with what has been described above.

The inner and outer hopper may in alternative embodiments have other polygonal shapes such as square, pentagonal etc. The inner and outer hoppers may also be circular. The polygonal shape is preferable since it makes the manufacturing of the outlets and in particular the hatches much easier since they can be made flat. The polygonal shape also reduces the wear on the hopper and the dust emission from the crusher.

In an alternative embodiment the horizontal leg 104 of the direction arm 66 may have a length which is adjustable. Thus the length of the horizontal leg could be adjusted to accommodate different feed material types and sizes. The length of the horizontal leg could also be adjusted to optimise the reduction of dust emission from the crusher.

Above it has been described that the hillsides 108, 110 on which the second flow of material M2 slides are formed by material accumulating on the direction arm 66 and against the cavity ring 78 and the collection plate 80 respectively. It is however also possible to form a prefabricated hillside of e.g. a steel sheet, a ceramic tile or a similar plate, said hillside having a desired tangential slope in relation to the rotor immediately from the start of the crusher. However, hillsides 108 and 110 that are made up of accumulated material have the advantage of avoiding the wear problems that would be associated with prefabricated hillsides made of a steel sheet or an other material.

The invention claimed is:

1. A vertical shaft impact crusher for crushing material, said crusher comprising:

a rotor for accelerating a first flow of material to be crushed, a first feed means for vertically feeding the first flow of material to the rotor, a housing comprising a wall with a circumferential impact wall section against which the accelerated first flow of material may be crushed, a second feed means for feeding a second flow of material to be crushed into the path of the accelerated first flow of material, wherein the second feed means comprises means for forming at least one hillside on which the second flow of material may slide, the hillside having a slope being substantially tangential in relation to the rotor for directing the second flow of material in a direction having a substantially tangential component in relation to the rotor, such that the second flow of material will have a substantially tangential component of movement in relation to the rotor when reaching the path of the first flow of material.

2. A crusher according to claim 1, wherein the wall of the housing comprises a circumferential distributing wall section forming part of the second feed means and being located above said impact wall section, the second feed means comprising feed hopper means for feeding, in a first step, the second flow of material in a direction towards the distributing wall section, which is adapted to receive the second flow of material and to direct it against the impact wall section.

3. A crusher according to claim 2, wherein the feed hopper means comprises an inner hopper and an outer hopper surrounding the inner hopper, said hoppers having a common vertical axis substantially coinciding with the vertical axis of the rotor, the inner hopper being provided with at least one outlet for allowing the second flow of material fed to the inner hopper to enter a space formed between the inner and the outer hoppers, an "L"-shaped direction arm being fixed in the space between said hoppers just outside said outlet to facilitate the building of a hillside of accumulated material, the hillside having a slope being tangential in relation to the rotor for directing the second flow of material towards the distributing wall section.

4. A crusher according to claim 3, wherein a horizontal leg of the "L"-shaped direction arm is pointing in the rotational direction of the rotor, such that any dust entrained by the rotor in a direction having an upwardly directed component and a component being tangential in relation to the rotor will be hindered by a vertical leg of the direction arm.

5. A crusher according to claim 3, wherein the inner and outer hoppers have a polygonal shape as seen from above.

6. A crusher according to claim 2, wherein the second feed means further comprises the upper surface of a ring fixed to the inner side of the wall of said housing to separate the distributing wall section from the impact wall section located below it.

7. A crusher according to claim 6, wherein the second feed means further comprises at least one vertical collection plate extending radially with respect to the rotor, the collection plate being fixed to the upper face of the ring at such a location that a part of the second flow of material fed towards the distributing wall section in said first step will accumulate against the collection plate to form a hillside of material, the hillside having a slope being substantially tangential in relation to the rotor for giving the second flow of material a substantially tangential component of movement in relation to the rotor when reaching the path of the first flow of material.

8. A method of crushing material, said method comprising the steps of feeding a first flow of material to be crushed to a rotor rotating around a vertical axis, in said rotor, accelerating said first flow of material towards an impact wall section of a housing surrounding the rotor, feeding a second flow of material to be crushed into the path of the accelerated first flow of material wherein feeding the second flow of material in a direction having a substantially tangential component in relation to the rotor, such that the second flow of material will have a substantially tangential component of movement in relation to the rotor when reaching the path of the first flow of material.

9. A method according to claim 8, wherein the second flow of material is fed into the path of the first flow of material adjacent to the impact wall section.

10. A method according to claim 8, wherein the second flow of material is fed from a position adjacent to the axis of the rotor towards a wall of the housing in a direction having a substantial tangential component in relation to the rotor.

* * * * *